US010774515B1

(12) United States Patent
Esquivel

(10) Patent No.: US 10,774,515 B1
(45) Date of Patent: Sep. 15, 2020

(54) ELONGATED TOILET FLANGE

(71) Applicant: Kenny Esquivel, Upland, CA (US)

(72) Inventor: Kenny Esquivel, Upland, CA (US)

( * ) Notice: Subject to any disclaimer, the term of this patent is extended or adjusted under 35 U.S.C. 154(b) by 23 days.

(21) Appl. No.: 16/285,434

(22) Filed: Feb. 26, 2019

(51) Int. Cl.
*E03D 11/16* (2006.01)
*E03D 11/17* (2006.01)

(52) U.S. Cl.
CPC ..... *E03D 11/16* (2013.01); *E03D 11/17* (2013.01)

(58) Field of Classification Search
CPC ..... E03D 11/16; E03D 11/17
USPC ..... 4/252.4
See application file for complete search history.

(56) References Cited

U.S. PATENT DOCUMENTS

| | | | | |
|---|---|---|---|---|
| 2,479,837 | A * | 8/1949 | Hollaender | E03C 1/20 285/60 |
| 2,673,985 | A | 4/1954 | Gay | |
| 4,780,915 | A | 11/1988 | Cuschera | |
| 4,886,302 | A | 12/1989 | Forbes | |
| D334,051 | S | 3/1993 | Fell, Sr. | |
| 5,492,372 | A | 2/1996 | Dranberg | |
| 6,416,084 | B1 | 7/2002 | Mantyla | |
| 6,442,769 | B1 | 9/2002 | Phillips | |
| 6,581,214 | B1 * | 6/2003 | Love | E03D 11/16 285/56 |
| 6,751,812 | B2 | 6/2004 | Malloy | |
| 8,910,321 | B2 | 12/2014 | Coronado | |
| 10,294,647 | B2 * | 5/2019 | Coronado | E03D 11/16 |
| 2011/0162132 | A1 * | 7/2011 | Pen Nuri | E03D 11/16 4/252.4 |
| 2012/0240319 | A1 | 9/2012 | Yssel | |
| 2013/0219603 | A1 * | 8/2013 | Wendorff | E03D 11/16 4/252.4 |
| 2014/0208495 | A1 * | 7/2014 | Wang | E03D 11/16 4/252.4 |
| 2014/0359927 | A1 * | 12/2014 | Hong | E03D 11/16 4/252.4 |

FOREIGN PATENT DOCUMENTS

| | | | |
|---|---|---|---|
| CA | 2930239 | A | 7/2018 |

* cited by examiner

*Primary Examiner* — Jeremy Carroll
(74) *Attorney, Agent, or Firm* — Kyle A. Fletcher, Esq.

(57) ABSTRACT

The elongated toilet flange is configured for use with toilet. The toilet further comprises a discharge port and a DWV floor outlet. The elongated toilet flange forms a fluidic connection between the discharge port and the DWV floor outlet such that biological excretions and eliminations received by the toilet are transferred through the discharge port into the DWV floor outlet. The elongated toilet flange is an irregular disk structure that further comprises a first wing structure and a second wing structure. The first wing structure and the second wing structure form elongated lobes that provide a more secure fluidic connection relative to a traditional circular toilet flange.

18 Claims, 3 Drawing Sheets

ELONGATED TOILET FLANGE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of fixed constructions including water supply sewage, and water closets, more specifically, a detail of a part for a bowl in a water closet that connects the bowl to a floor outlet. (E03D11/16)

SUMMARY OF INVENTION

The elongated toilet flange is configured for use with toilet. The toilet further comprises a discharge port and a DWV floor outlet. The elongated toilet flange forms a fluidic connection between the discharge port and the DWV floor outlet such that biological excretions and eliminations received by the toilet are transferred through the discharge port into the DWV floor outlet. The elongated toilet flange is an irregular disk structure that further comprises a first wing structure and a second wing structure. The first wing structure and the second wing structure form elongated lobes that provide a more secure fluidic connection relative to a traditional circular toilet flange.

These together with additional objects, features and advantages of the elongated toilet flange will be readily apparent to those of ordinary skill in the art upon reading the following detailed description of the presently preferred, but nonetheless illustrative, embodiments when taken in conjunction with the accompanying drawings.

In this respect, before explaining the current embodiments of the elongated toilet flange in detail, it is to be understood that the elongated toilet flange is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the elongated toilet flange.

It is therefore important that the claims be regarded as including such equivalent construction insofar as they do not depart from the spirit and scope of the elongated toilet flange. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
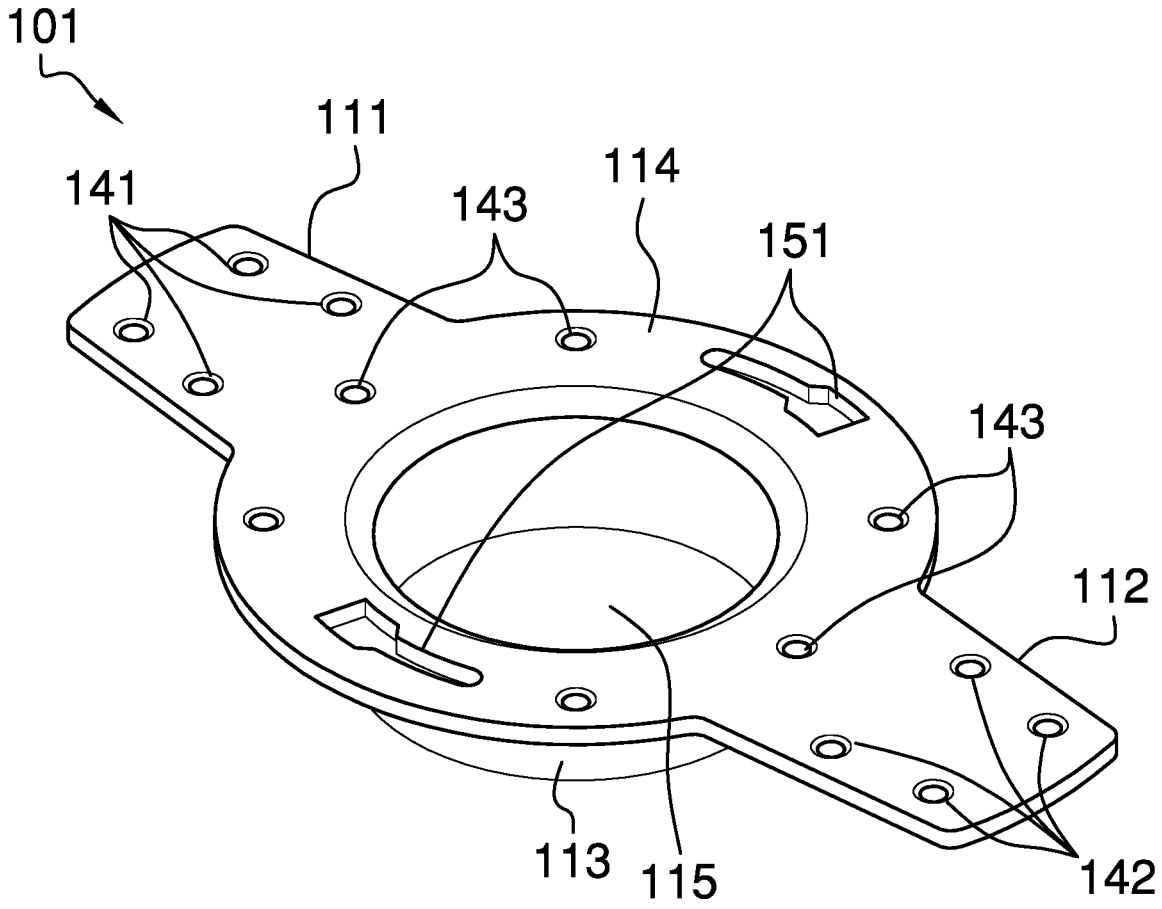
FIG. 1 is a perspective view of an embodiment of the disclosure.
Figure 2:
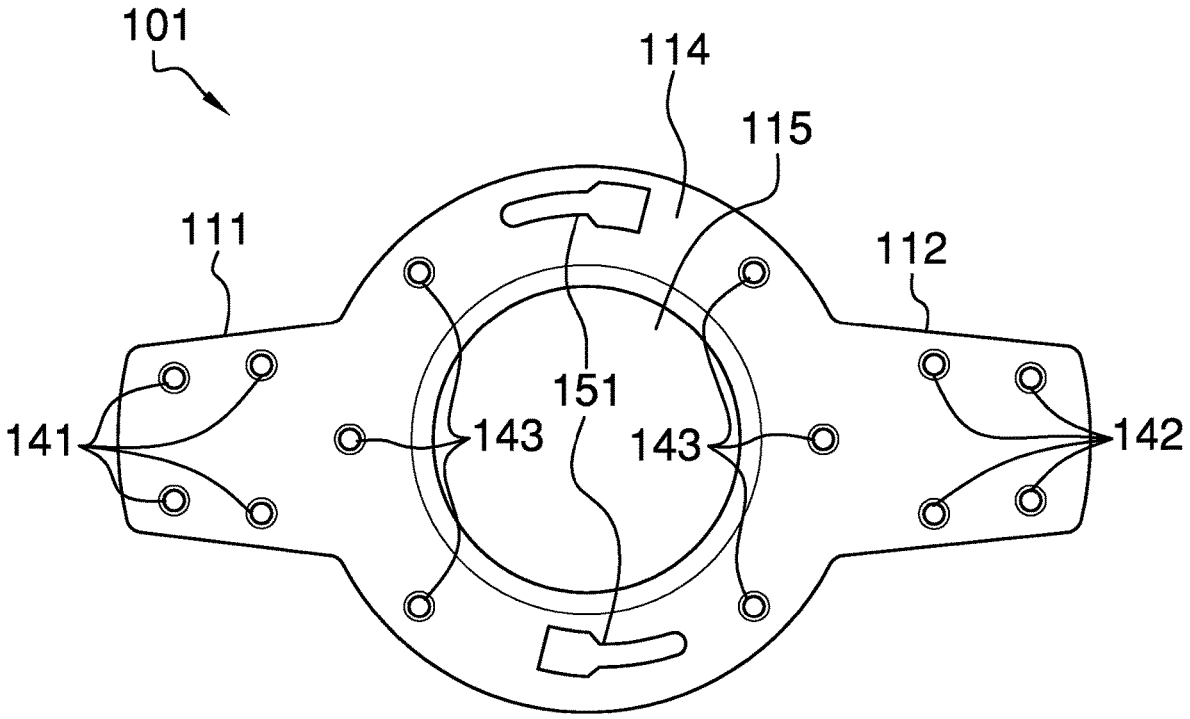
FIG. 2 is a top view of an embodiment of the disclosure.
Figure 3:
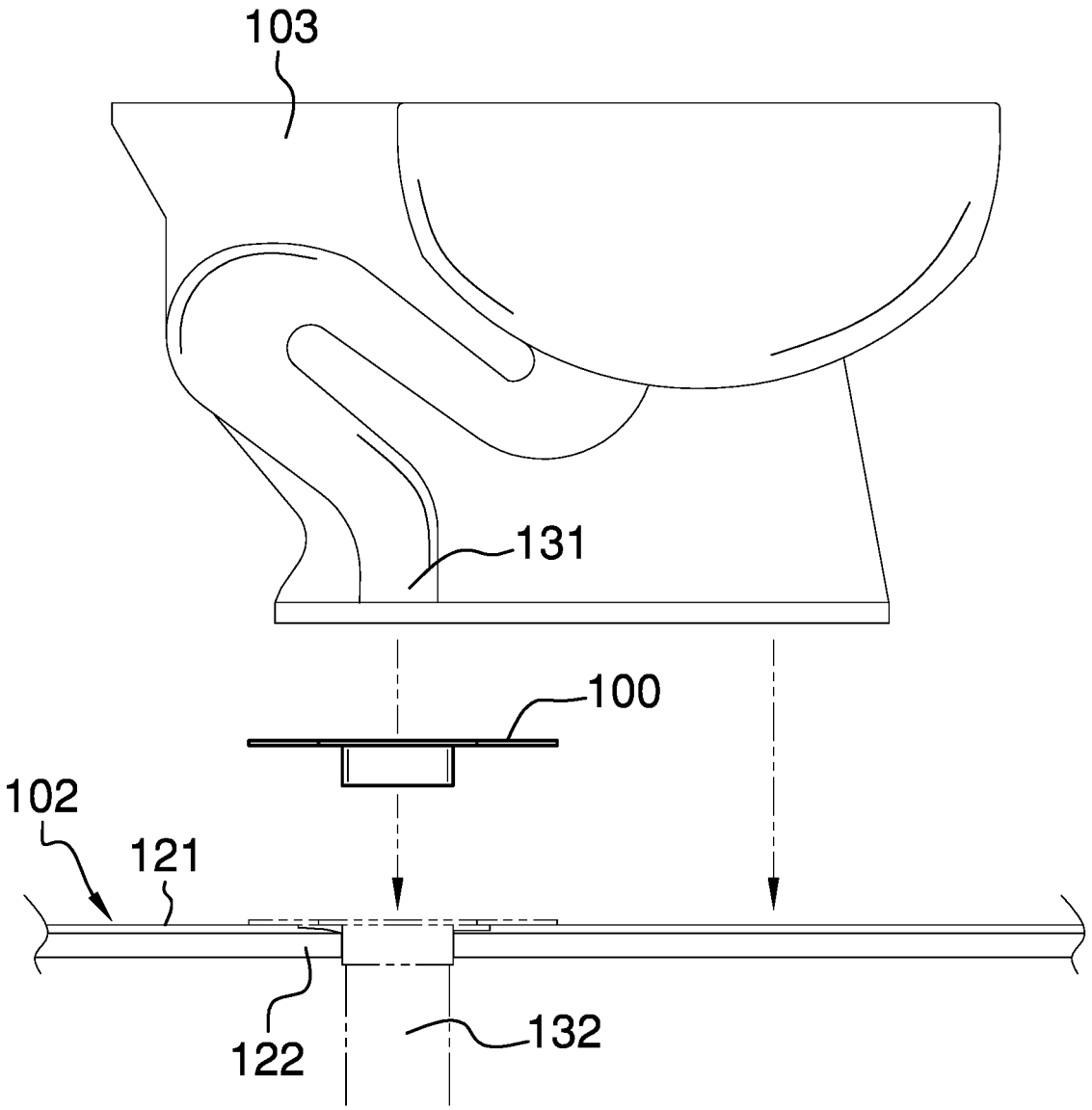
FIG. 3 is an exploded view of an embodiment of the disclosure.

Detailed reference will now be made to one or more potential embodiments of the disclosure, which are illustrated in FIGS. 1 through 3.

The elongated toilet flange 100 (hereinafter invention) is configured for use with toilet 103. The toilet 103 further comprises a discharge port 131 and a DWV floor 102 outlet 132. The DWV floor 102 outlet 132 is a port into the DWV that is located in a floor 102 outlet 132. The elongated toilet flange forms a fluidic connection between the discharge port 131 and the DWV floor 102 outlet 132 such that biological excretions and eliminations received by the toilet 103 are transferred through the discharge port 131 into the DWV floor 102 outlet 132. The elongated toilet flange is an irregular disk structure referred to as the elongated flange 101. The elongated flange 101 further comprises a first wing structure 111 and a second wing structure 112. The first wing structure 111 and the second wing structure 112 from elongated lobes that provide a more secure fluidic connection relative to a traditional circular toilet 103 flange.

The floor 102 is a horizontal supporting surface. The toilet 103 mounts on the floor 102. The floor 102 is defined in greater detail elsewhere in this disclosure. The floor 102 comprises a superior surface 121, a subfloor 122, and a DWV floor 102, outlet 132.

The superior surface 121 is a flooring that forms the visible surface of the floor 102. Common examples of a superior surface 121 include but are not limited to: tile, hardwood flooring, engineered wood flooring, laminate flooring, and carpeting. This disclosure assumes that the invention 100 is installed onto the superior surface 121. The subfloor 122 forms an inferior surface on which the superior surface 121 mounts. The subfloor 122 provides the structural strength required to support the toilet 103. The elongated flange 101 is screwed directly into the subfloor 122.

The DWV floor 102 outlet 132 is a port formed in the DWV of the structure that contains the toilet 103. The DWV floor 102 outlet 132 is located in the floor 102. The DWV floor 102 outlet 132 is sized to receive the pipe 113 of the elongated flange 101.

The toilet 103 is a receptacle that: a) receives biological excretions and eliminations 201; and, b) discharges the received biological excretions and eliminations 201 into a DWV through a discharge port 131 into a DWV floor 102 outlet 132. The toilet 103 is defined in greater detail elsewhere in this disclosure. The toilet 103 further comprises a discharge port 131. The discharge port 131 is an outlet formed within the fluid flow path of the toilet 103. The biological excretions and eliminations 201 exit the toilet 103 through the discharge port 131 and the elongated flange 101 into the DWV floor 102 outlet 132.

The elongated flange 101 is a mechanical structure. The elongated flange 101 forms the fluidic connection between the discharge port 131 between the toilet 103 and the DWV floor 102 outlet 132 mounted in the floor 102. The elongated flange 101 forms a liquid and gas impermeable seal that prevents leakage of the biological excretions and eliminations 201 flowing through the discharge port 131 onto the floor 102. In conjunction with a traditional wax ring, the elongated flange 101 permanently attaches to the subfloor 122 of the floor 102 to form a fluid impermeable connection between the toilet 103 and the DWV floor 102 outlet 132. The elongated flange 101 comprises a first wing structure 111, a second wing structure 112, a pipe 113, and a circular inner structure 114. The first wing structure 111 is further defined with a major axis. The second wing structure 112 is further defined with a major axis.

The first wing structure 111 screws into the subfloor 122 of the floor 102. The second wing structure 112 screws into the subfloor 122 of the floor 102. The circular inner structure 114 screws into the subfloor 122 of the floor 102. The pipe 113 inserts into the DWV floor 102 outlet 132.

The first wing structure 111 is a rectilinear disk structure. The first wing structure 111 is a rounded structure. The first wing structure 111 attaches to the circular inner structure 114 such that the first wing structure 111 and the circular inner structure 114 combine to form a continuous single structure. The major axis of the first wing structure 111 aligns with the center of the circular inner structure 114.

The first wing structure 111 forms a first elongated lobe of the elongated flange 101. The first wing structure 111 increases the surface area of contact between the elongated flange 101 and the floor 102 relative to a traditional toilet 103 flange. This increase in the surface area of contact results in a more secure fluidic connection between the discharge port 131 and the DWV floor 102 outlet 132.

The first wing structure 111 further comprises a first plurality of screw holes 141. Each of the first plurality of screw holes 141 is an aperture that is formed through both faces of the disk structure of the first wing structure 111. Each of the first plurality of screw holes 141 is sized to receive a screw used to attach the first wing structure 111 to the subfloor 122 of the floor 102.

The second wing structure 112 is a rectilinear disk structure. The second wing structure 112 is a rounded structure. The second wing structure 112 attaches to the circular inner structure 114 such that the second wing structure 112 and the circular inner structure 114 combine to form a continuous single structure. The major axis of the second wing structure 112 aligns with the center of the circular inner structure 114. The major axis of the second wing structure 112 further aligns with the major axis of the first wing structure 111.

The second wing structure 112 forms a second elongated lobe of the elongated flange 101. The second wing structure 112 increases the surface area of contact between the elongated flange 101 and the floor 102 relative to a traditional toilet 103 flange. This increase in the surface area of contact results in a more secure fluidic connection between the discharge port 131 and the DWV floor 102 outlet 132.

The second wing structure 112 further comprises a second plurality of screw holes 142. Each of the second plurality of screw holes 142 is an aperture that is formed through both faces of the disk structure of the second wing structure 112. Each of the second plurality of screw holes 142 is sized to receive a screw used to attach the second wing structure 112 to the subfloor 122 of the floor 102.

The pipe 113 is a structure that is configured for fluid transfer. The pipe 113 inserts into the DWV floor 102 outlet 132 such that the biological excretions and eliminations 201 flows through the pipe 113 into the DWV floor 102 outlet 132 for discharge.

The circular inner structure 114 is a ring-shaped disk structure. The circular inner structure 114 mounts over the DWV floor 102 outlet 132 in the floor 102. The circular inner structure 114 forms a flange around the pipe 113 that secures the pipe 113 into the DWV floor 102 outlet 132. The circular inner structure 114 further comprises a flange aperture 115. The pipe 113 attaches to the flange aperture 115 of the circular inner structure 114. The pipe 113 forms the liquid and gas impermeable seal at the flange aperture 115 of the circular inner structure 114.

The flange aperture 115 is an aperture formed through the faces of the disk structure of the circular inner structure 114. The perimeter of the flange aperture 115 is geometrically similar to the perimeter of the circular inner structure 114. The flange aperture 115 is coaxially positioned relative to the circular inner structure 114. The pipe 113 attaches to the flange aperture 115 such that the pipe 113 is coaxially positioned relative to the circular inner structure 114. The flange aperture 115 forms the opening through which the biological excretions and eliminations 201 flows into the pipe 113.

The circular inner structure 114 further comprises a third plurality of screw holes 143 and a plurality of keyholes 151. Each of the third plurality of screw holes 143 is an aperture that is formed through both faces of the disk structure of the circular inner structure 114. Each of the third plurality of screw holes 143 is sized to receive a screw used to attach the circular inner structure 114 to the subfloor 122 of the floor 102. Each of the plurality of keyholes 151 is a keyhole-shaped that is formed through both faces of the disk structure of the circular inner structure 114. Each of the plurality of keyholes 151 is sized to receive a screw that is previously screwed into the subfloor 122 such that the screw fits into the selected keyhole. The plurality of keyholes 151 are used to fix the elongated flange 101 into position before the elongated flange 101 is screwed into the subfloor 122.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Coaxial: As used in this disclosure, coaxial is a term that refers to a first object that is inserted or contained within a second object such: 1) that the first object and the second object share the same center point if the or first object and the second object are treated as a two-dimensional objects; or, 2) that the first object and the second object share the same center axis if the or first object and the second object are treated as a prism. Coaxial objects are often referred to as concentric.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Diameter: As used in this disclosure, a diameter of an object is a straight line segment (or a radial line) that passes through the center (or center axis) of an object. The line segment of the diameter is terminated at the perimeter or boundary of the object through which the line segment of the diameter runs. A radius refers to the line segment that overlays a diameter with one termination at the center of the object. A span of a radius is always one half the span of the diameter.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

DWV: As used in this disclosure, DWV is an acronym for drainage, waste, and vent. With a residential plumbing system, DWV refers to the plumbing subnetwork that transports wastewater out of the residence to an appropriate wastewater handling system.

Extension Structure: As used in this disclosure, an extension structure is an inert physical structure that is used to extend or bridge the reach between any two objects.

Flange: As used in this disclosure, a flange is a protruding rib, edge, or collar that is used to hold an object in place or to attach a first object to a second object.

Floor: As used in this disclosure a floor refers to either: 1) the inferior horizontal surface of a chamber upon which one stands; 2) the inferior horizontal surface of a structure; 3) a bottom or base; or, 4) the lower limit of a range. The selection of the definition depends on the context. In situations where the context is unclear the third definition should be used.

Flooring: As used in this disclosure, the term flooring refers to the physical structure that forms the physical horizontal surface of a floor.

Fluid: As used in this disclosure, a fluid refers to a state of matter wherein the matter is capable of flow and takes the shape of a container it is placed within. The term fluid commonly refers to a liquid or a gas.

Fluidic Connection: As used in this disclosure, a fluidic connection refers to a tubular structure that transports a fluid from a first object to a second object. Methods to design and use a fluidic connections are well-known and documented in the mechanical, chemical, and plumbing arts.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Keyhole: As used in this disclosure, a keyhole refers to a negative space formed through a surface. The keyhole has a characteristic shape of a rectangle with a circle located at the narrow end of the rectangle. The diameter of the circle is greater than the span of the narrow end of the rectangle. The keyhole is used to secure an object to the surface. Specifically, the object has a disk shape mounted on an extension structure. The diameter of the disk is less than the diameter of the circle such that the disk will insert through the circle. The diameter of the disk is greater than the span of the narrow end of the rectangle such when the disk is slid underneath the rectangle the disk will not pass through the rectangle thereby securing the object to the surface. The size of the extension structure is selected such that the extension will slide into the rectangle.

Liquid: As used in this disclosure, a liquid refers to a state (phase) of matter that is fluid and that maintains, for a given pressure, a fixed volume that is independent of the volume of the container.

Major and Minor Axes: As used in this disclosure, the major and minor axes refer to a pair of perpendicular axes that are defined within a structure. The length of the major axis is always greater than or equal to the length of the minor axis. The major axis forms the longest symmetric bifurcation of the structure. The major and minor axes intersect at the center of the structure. The major axis is always parallel or perpendicular to an edge of a rectangular or rectilinear structure.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Perimeter: As used in this disclosure, a perimeter is one or more curved or straight lines that bound an enclosed area on a plane or surface. The perimeter of a circle is commonly referred to as a circumference.

Pipe: As used in this disclosure, a pipe is a hollow prism-shaped device that is suitable for use in transporting a fluid. The line that connects the center of the first base of the prism to the center of the second base of the prism is referred to as the axis of the prism or the centerline of the pipe. When two pipes share the same centerline they are said to be aligned. In this disclosure, the terms inner dimension of a pipe and outer dimension are used as they would be used by those skilled in the plumbing arts.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Radial: As used in this disclosure, the term radial refers to a direction that: 1) is perpendicular to an identified central axis; or, 2) projects away from a center point.

Reach: As used in this disclosure, reach refers to a span of distance between any two objects.

Rectilinear: As used in this disclosure, rectilinear is an adjective that is used to describe an object that: 1) moves in a straight line or lines; 2) consists of a straight line or lines; 3) is bounded by a straight line or lines; or, 4) is otherwise characterized by a straight line or lines.

Ring: As used in this disclosure, a ring is a term that is used to describe a disk-like structure through which an aperture is formed. Rings are often considered loops.

Rounded: A used in this disclosure, the term rounded refers to the replacement of an apex, vertex, or edge or brink of a structure with a (generally smooth) curvature wherein the concave portion of the curvature faces the interior or center of the structure.

Screw: As used in this disclosure, to screw is a verb meaning: 1) to fasten or unfasten (unscrew) a threaded connection; or 2) to attach a helical structure to a solid structure.

Screw: As used in this disclosure, a screw is a cylindrical, or tapered cylindrical, structure that is formed with an exterior screw thread. A screw is used to attach a first object to a second object. Screws are well known and documented in the mechanical arts.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Toilet: As used in this disclosure, a toilet is a port into which biological excretions and eliminations are deposited in preparation of introducing the excretions and eliminations into an externally provided wastewater handling system. A typical toilet comprises a bowl, a flush mechanism, and a refill mechanism.

Tradition: As used in this disclosure, a tradition refers to: 1) a set of thoughts or expectations regarding a subject or object; or, 2) a method of using an object; that, 3) is perceived to be widely or commonly shared across a population of people; and that, 4) is perceived to be widely or commonly shared across at least two generations within the population of people.

With respect to the above description, it is to be realized that the optimum dimensional relationship for the various components of the invention described above and in FIGS. 1 through 3 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An elongated toilet flange structure comprising a flange;

wherein the flange further comprises a first wing structure and a second wing structure;

wherein the elongated toilet flange structure is configured for use with toilet;

wherein the toilet further comprises a discharge port and a DWV floor outlet;

wherein the DWV floor outlet is a port into a DWV that is located in a floor;

wherein the elongated toilet flange forms a fluidic connection between the discharge port and the DWV floor outlet;

wherein the flange further comprises a pipe, and a circular inner structure;

wherein the first wing structure screws into the subfloor of the floor;

wherein the second wing structure screws into the subfloor of the floor;

wherein the circular inner structure screws into the subfloor of the floor;

wherein the pipe inserts into the DWV floor outlet;

wherein the first wing structure attaches to the circular inner structure such that the first wing structure and the circular inner structure combine to form a continuous single structure;

wherein the second wing structure attaches to the circular inner structure such that the second wing structure and the circular inner structure combine to form a continuous single structure.

2. The elongated toilet flange structure according to claim 1 wherein the floor is a horizontal supporting surface;

wherein the toilet mounts on the floor;

wherein the toilet further comprises a discharge port;

wherein the floor comprises a superior surface, a subfloor, and a DWV floor outlet;

wherein the superior surface is a flooring that forms the visible surface of the floor;

wherein the subfloor forms an inferior surface on which the superior surface mounts;

wherein the subfloor provides the structural strength required to support the toilet.

3. The elongated toilet flange structure according to claim 2 wherein the flange is a disk structure;

wherein the first wing structure and the second wing structure form elongated lobes.

4. The elongated toilet flange structure according to claim 3 wherein the flange is screwed directly into the subfloor.

5. The elongated toilet flange structure according to claim 4 wherein the flange is a mechanical structure;

wherein the flange forms the fluidic connection between the discharge port between the toilet and the DWV floor outlet mounted in the floor;

wherein the flange forms a liquid and gas seal that prevents leakage of the biological excretions and eliminations flowing through the discharge port onto the floor;

wherein the flange attaches onto the superior surface as well as to the subfloor of the floor to form a fluid connection between the toilet and the DWV floor outlet.

6. The elongated toilet flange structure according to claim 5 wherein the first wing structure is further defined with a major axis;

wherein the second wing structure is further defined with a major axis.

7. The elongated toilet flange structure according to claim 6 wherein the major axis of the second wing structure aligns with the center of the circular inner structure;

wherein the major axis of the second wing structure further aligns with the major axis of the first wing structure.

8. The elongated toilet flange structure according to claim 7 wherein the major axis of the first wing structure aligns with the center of the circular inner structure.

9. The elongated toilet flange structure according to claim 8 wherein the pipe is a structure that is configured for fluid transfer;

wherein the pipe inserts into the DWV floor outlet.

10. The elongated toilet flange structure according to claim 9 wherein the circular inner structure is a ring-shaped disk structure;

wherein the circular inner structure mounts over the DWV floor outlet in the floor;

wherein the circular inner structure forms a flange around the pipe that secures the pipe into the DWV floor outlet.

11. The elongated toilet flange structure according to claim 10 wherein the circular inner structure further comprises a flange aperture;

wherein the flange aperture is an aperture formed through the faces of the disk structure of the circular inner structure;

wherein the perimeter of the flange aperture is identical to the perimeter of the circular inner structure.

12. The elongated toilet flange structure according to claim 11 wherein the flange aperture is coaxially positioned relative to the circular inner structure.

13. The elongated toilet flange structure according to claim 12 wherein the pipe attaches to the flange aperture of the circular inner structure;

wherein the pipe forms the liquid and gas seal at the flange aperture of the circular inner structure.

14. The elongated toilet flange structure according to claim 13 wherein the pipe attaches to the flange aperture such that the pipe is coaxially positioned relative to the circular inner structure.

15. The elongated toilet flange structure according to claim 14 wherein the first wing structure further comprises a first plurality of screw holes.

16. The elongated toilet flange structure according to claim 15 wherein the second wing structure further comprises a second plurality of screw holes.

17. The elongated toilet flange structure according to claim 16 wherein the circular inner structure further comprises a third plurality of screw holes.

18. The elongated toilet flange structure according to claim 17 wherein the circular inner structure further comprises a plurality of keyholes;

wherein each of the plurality of keyholes is a keyhole-shaped that is formed through both faces of the disk structure of the circular inner structure;

wherein the plurality of keyholes fix the flange into position before the flange is screwed into the subfloor.

* * * * *